US006194953B1

(12) United States Patent
Mueller et al.

(10) Patent No.: US 6,194,953 B1
(45) **Date of Patent: *Feb. 27, 2001**

(54) CIRCUIT CONFIGURATION FOR GENERATING AN INTERNAL SUPPLY VOLTAGE

(75) Inventors: Gerhard Mueller, Wappingers Falls, NY (US); Joerg Weller, München (DE)

(73) Assignee: Infineon Technologies AG, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/063,314

(22) Filed: Apr. 20, 1998

(30) Foreign Application Priority Data

Apr. 18, 1997 (DE) ..... 197 16 430

(51) Int. Cl.[7] ..... G05F 1/10
(52) U.S. Cl. ..... 327/535; 327/82; 327/543
(58) Field of Search ..... 327/530, 535, 327/50, 63, 82, 66, 306, 307, 538, 543, 540, 541; 365/226; 323/311, 313, 315, 317

(56) References Cited

U.S. PATENT DOCUMENTS

| | | | | |
|---|---|---|---|---|
| 5,077,518 | * | 12/1991 | Han | 323/275 |
| 5,272,393 | * | 12/1993 | Horiguchi et al. | 327/535 |
| 5,446,397 | * | 8/1995 | Yotsuyanagi | 327/66 |
| 5,530,640 | | 6/1996 | Hara et al. | 363/60 |
| 5,554,953 | * | 9/1996 | Shibayama et al. | 327/541 |
| 5,566,185 | | 10/1996 | Hori et al. | 371/22.1 |

FOREIGN PATENT DOCUMENTS

| | | |
|---|---|---|
| 42 26 048 A1 | 2/1993 | (DE) . |
| 43 32 452 A1 | 5/1994 | (DE) . |
| 0 063 483 A2 | 10/1982 | (EP) . |

* cited by examiner

*Primary Examiner*—Timothy P. Callahan
*Assistant Examiner*—Minh Nguyen
(74) *Attorney, Agent, or Firm*—Herbert L. Lerner; Laurence A. Greenberg; Werner H. Stemer

(57) ABSTRACT

A circuit configuration generates an internal supply voltage for integrated circuits at two different levels, each of which are constant. The selection of the levels is made solely on the basis of the magnitude of an external supply voltage. As a result, it is possible to switch back and forth between an operating mode, in which the internal supply voltage is at a usual value for operation, and a test mode, in which the internal supply voltage is at an elevated value. The invention is used particularly in semiconductor memories.

6 Claims, 2 Drawing Sheets

RG
$V_{CC\ ext}$
$V_{CC\ ext}$
$V_{CC\ ext}$
$V_{CC\ ext}$
P9
K2
P3
P4
P5
P6
P7
P8
DK
$V_{SS}$
P2
K1
R
INV
$V_{SS}$
$V_{Reference}$
VE
P10
$V_{CC\ int}$
N1
P1
VREF1
VREF2

CIRCUIT CONFIGURATION FOR GENERATING AN INTERNAL SUPPLY VOLTAGE

BACKGROUND OF THE INVENTION

FIELD OF THE INVENTION

The invention relates to a circuit configuration for generating an internal supply voltage, with which integrated circuits can be operated.

As the scale of integration in integrated circuits increases, the dimensions of the integrated components become smaller and smaller. It is highly important that the space requirement per memory cell be slight, especially in semiconductor memories, in which the storage capacity and thus the number of memory cells are being increased more and more.

However, the increased scale of integration has meant that the electrical field intensity at the individual components of the integrated circuit, for instance at the gate oxides of transistors, is greater in comparison with memories having a lesser scale of integration. Thus the stress exerted on the components also rises, leading to a growth in failure rates. In order to avoid that, the cell fields of semiconductor memories are operated with an internal supply voltage. As a rule, it is below the external supply voltage with which the external circuit located outside the cell fields is operated. For instance, in the case of the cell field, the voltage of 5 V of the outer circuit is reduced to the internal supply voltage of 3.3 V. Various circuits for reducing the voltage are known.

The dependency of the service life of the cell field on the internal supply voltage being applied and on the resultant electrical field can be exploited in a so-called burn-in test. In it, the cell field is operated at a higher voltage than the internal supply voltage used for proper operation. The resultant failures of the memories make quality control possible.

Only the external supply voltage can be applied to the semiconductor memory from outside. The internal supply voltage, which should be as constant as possible and as independent as possible of external interfering factors, is generated by a voltage generator provided specifically for that purpose. Since the internal supply voltage is regulated to a certain value by the voltage generator, increasing the external supply voltage does not at the same time lead to an increase in the internal supply voltage. It is therefore not possible to perform the burn-in test with conventional voltage generators.

A voltage generator which furnishes a regulated, constant internal supply voltage as long as the external supply voltage is below a certain value, is known from German Published, Non-Prosecuted Patent Application DE 42 26 048 A1. If the external supply voltage exceeds that certain value, then the internal supply voltage rises with the external supply voltage. That is attained due to the fact that either a constant comparison voltage or the external supply voltage, depending on whether the external supply voltage is below or above that certain value, is supplied to a closed control loop that generates the internal supply voltage.

The disadvantage of that voltage generator is that a relatively complicated and expensive device is needed for the burn-in test in which semiconductor memories with that voltage generator are to be tested. That is because in order to expose the semiconductor memory to a defined stress, the external supply voltage must be kept at a very specific value, which to that end should be as constant as possible.

SUMMARY OF THE INVENTION

It is accordingly an object of the invention to provide a circuit configuration for generating an internal supply voltage, which overcomes the hereinafore-mentioned disadvantages of the heretofore-known devices of this general type and with which a defined, disproportionately increased internal supply voltage is furnished in a simple way.

With the objects of the invention in view, there is also provided a circuit configuration, comprising a device for generating an internal supply voltage derived from an external supply voltage for operating an integrated circuit; and a reference voltage generator for detecting a voltage proportional to the external supply voltage and for generating a reference voltage as a function of a magnitude of the voltage proportional to the external supply voltage, to control the device for generating the internal supply voltage, the reference voltage generator generating at least two constant voltage values of the reference voltage.

The invention has the advantage of ensuring that the disproportionately increased internal supply voltage is not sensitive to fluctuations in the external supply voltage. Testing the semiconductor memories into which the circuit configuration of the invention is integrated makes only slight demands of a testing device, for instance for performing the burn-in test.

In accordance with another feature of the invention, the reference voltage generator has at least two voltage sources.

In accordance with a further feature of the invention, the reference voltage generator has a switching transistor connected through a circuit node in series with a diode chain.

In accordance with an added feature of the invention, at least one of the voltage sources has a double current mirror circuit.

In accordance with an additional feature of the invention, there is provided a circuit device controllable as a function of a potential at the circuit node for causing one of the voltage sources to assume the reference voltage.

In accordance with yet another feature of the invention, the diode chain has ends, and the switching transistor has a channel side connected to the external supply voltage and to one of the ends of the diode chain.

In accordance with a concomitant feature of the invention, the internal supply voltage is proportional to a voltage value of the reference voltage.

Other features which are considered as characteristic for the invention are set forth in the appended claims.

Although the invention is illustrated and described herein as embodied in a circuit configuration for generating an internal supply voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
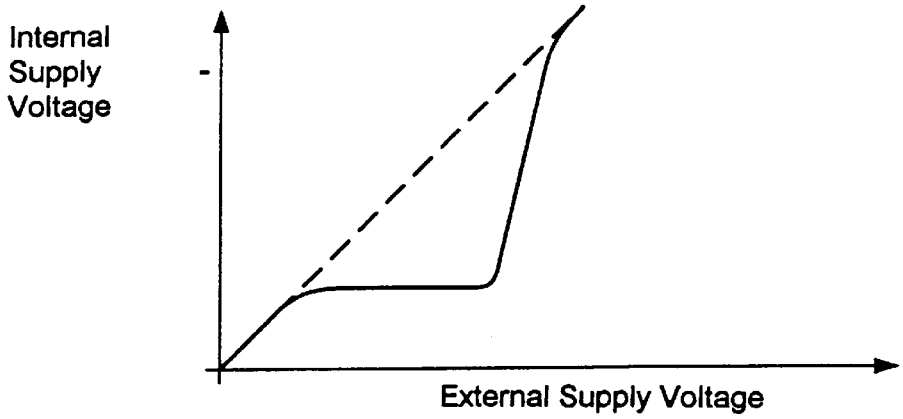
FIG 1A PRIOR ART
FIGS. 1A and 1B are graphs showing the course of an internal supply voltage in known circuit configurations.
Figure 1B:
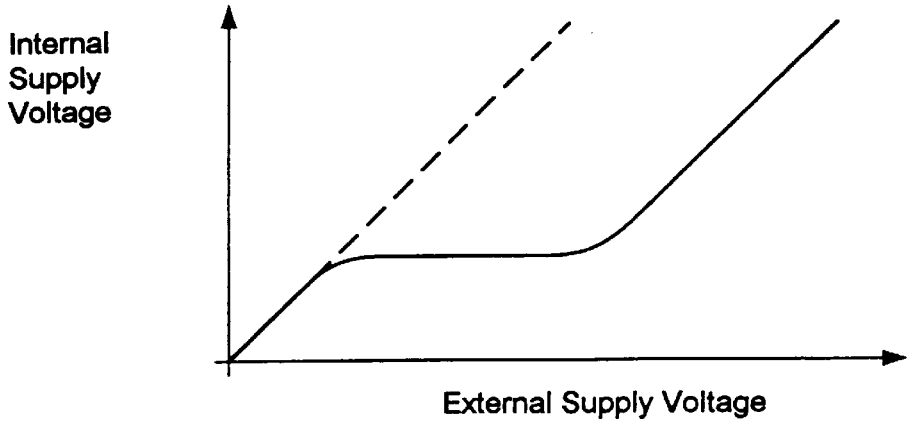
FIG 1B PRIOR ART

Referring now to the figures of the drawings in detail and first, particularly, to FIGS. 1A and 1B thereof, there are seen typical courses of an internal supply voltage in voltage generators of the prior art, plotted as a function of an external supply voltage. After a linear rise in the internal supply voltage, that voltage remains constant within a certain range of the external supply voltage. Beyond a certain value of the external supply voltage, the internal supply voltage follows along with the external supply voltage. It is thus possible that beyond that value, the internal supply voltage is either identical to the external supply voltage, as shown in FIG. 1A, or rises linearly with the external supply voltage, as shown in FIG. 1B.

Figure 2:
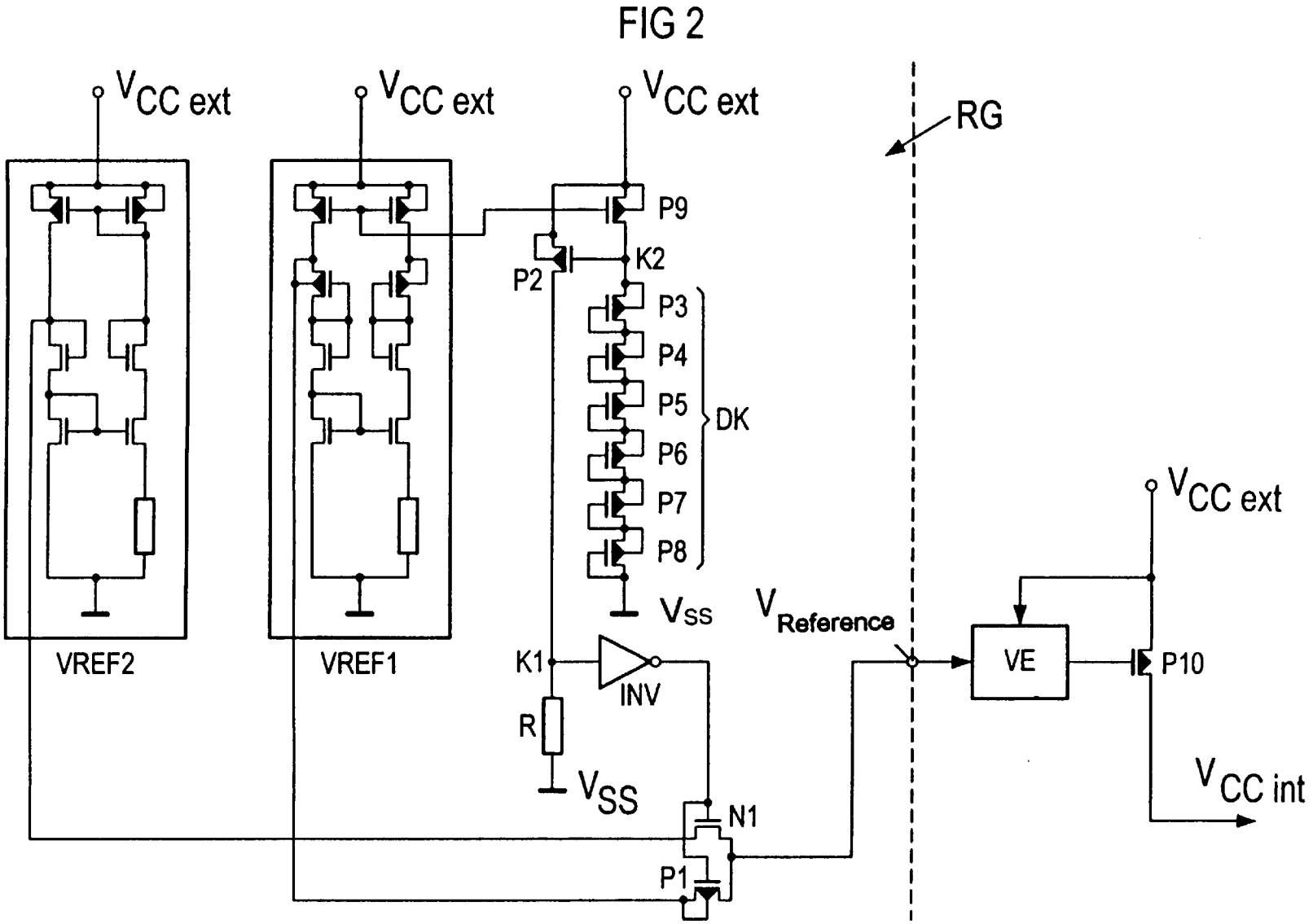
FIG. 2 is a schematic and block diagram showing one possible embodiment of a circuit configuration of the invention.

FIG. 2 shows one possible embodiment of a circuit configuration of the invention for generating an internal supply voltage $V_{ccint}$. A reference voltage $V_{Reference}$ which is generated by a reference voltage generator RG, and an external supply voltage $V_{CCext}$, are supplied to a comparator VE.

An output of the comparator VE is connected to a control terminal of a controllable resistor P10. The controllable resistor P10 is also connected to the external supply voltage $V_{ccext}$ and to a terminal at which the internal supply voltage $V_{ccint}$ can be picked up. The external supply voltage $V_{CCext}$ is compared with the reference voltage $V_{Reference}$, and the controllable resistor P10 is triggered in such a way that the internal supply voltage $V_{CCint}$ assumes either the value of the reference voltage $V_{Reference}$ or a value that is proportional to the reference voltage $V_{Reference}$.

The reference voltage generator RG has a first voltage source VREF1 and a second voltage source VREF2. Both voltage sources VREF1, VREF2 are connected to the external supply voltage $V_{CCext}$. Each of the voltage sources may, for example, be made up of one double current mirror circuit. An output of the first voltage source VREF1 is connected to one channel-side terminal of a first switching transistor P1. In the same way, an output of the second voltage source VREF2 is connected to one channel-side terminal of a second switching transistor N1. The other channel-side terminals of the switching transistors N1 and P1 are interconnected and form an output of the reference voltage generator RG. The reference voltage $V_{Reference}$ is present at this output.

Control terminals of the switching transistors N1 and P1 are connected to one another and to an output of an inverter INV. An input of the inverter INV is connected to a first circuit node K1. A resistor R is located between the circuit node K1 and a reference potential $V_{SS}$. This resistor R may be formed of a field-effect transistor, for instance. The channel side of a third switching transistor P2 is connected between the external supply voltage $V_{CCext}$ and the first circuit node K1. A control input of the third switching transistor P2 is connected to a second circuit node K2. A diode chain DK is located between the second circuit node K2 and the reference potential $V_{SS}$. The diode chain DK includes at least one diode. In the present exemplary embodiment, the diode chain includes six transistors (P3–P8) connected as diodes.

The second circuit node K2 is also connected through the channel side of a fourth switching transistor P9 to the external supply voltage $V_{CCext}$. A control contact of the fourth switching transistor P9 is connected to the first voltage source VREF1. A voltage which is furnished in the first voltage source VREF1 and is proportional to the external supply voltage $V_{CCext}$ is applied to the control terminal of the fourth switching transistor P9.

The mode of operation of the circuit configuration of the invention will be explained below in terms of two cases, which result from different values for $V_{CCext}$.

If the magnitude of the supply voltage $V_{CCext}$ is below a certain limit value, such as the usual operating voltage of the memory, then the circuit node K2 is at low potential. The switching transistor P2 switches through and the circuit node K1 assumes a higher potential than the reference potential $V_{SS}$. This is the same as saying that a signal value HIGH is present at the input of the inverter INV. The output of the inverter INV consequently assumes a signal value LOW, and as a result the first switching transistor P1 switches through while the second switching transistor N1 is blocked. The reference voltage $V_{Reference}$ thus assumes the value of the voltage of the first voltage source VREF1.

If the external supply voltage $V_{CCext}$ continues to increase, then the potential at the circuit node K2 increases as well. If the external supply voltage $V_{CCext}$ reaches the limit value, then the switching transistor P2 blocks and the circuit node K1 assumes a potential that is only slightly above the reference potential $V_{SS}$. This is equivalent to a signal value LOW at the input of the inverter INV. The output of the inverter INV becomes HIGH. Thus the second switching transistor N1 switches through, and the first switching transistor P1 blocks. The reference voltage $V_{Reference}$ then assumes the value of the voltage of the second voltage source VREF2.

The determination as to whether the reference voltage $V_{Reference}$ is determined by the first voltage source VREF1 or by the second voltage source VREF2 accordingly depends solely on the magnitude of the external supply voltage $V_{CCext}$. The first voltage source VREF1 can thus be constructed in such a way that the reference voltage $V_{Reference}$ assumes a value which is suitable for regulating the internal supply voltage $V_{CCint}$ to the usual value for operation of the memory field, which is done through the comparator VE and the controllable resistor P10. Accordingly, the second voltage source VREF2 can be constructed in such a way that the internal supply voltage $V_{CCint}$ assumes a higher value than is usual for operation of the cell field. This disproportionately increased internal supply voltage is then used to perform a burn-in test.

The circuit configuration of the invention thus makes it possible for two different voltage levels of the internal supply voltage $V_{CCint}$ to be selected solely by way of the external supply voltage $V_{CCext}$.

Figure 3:
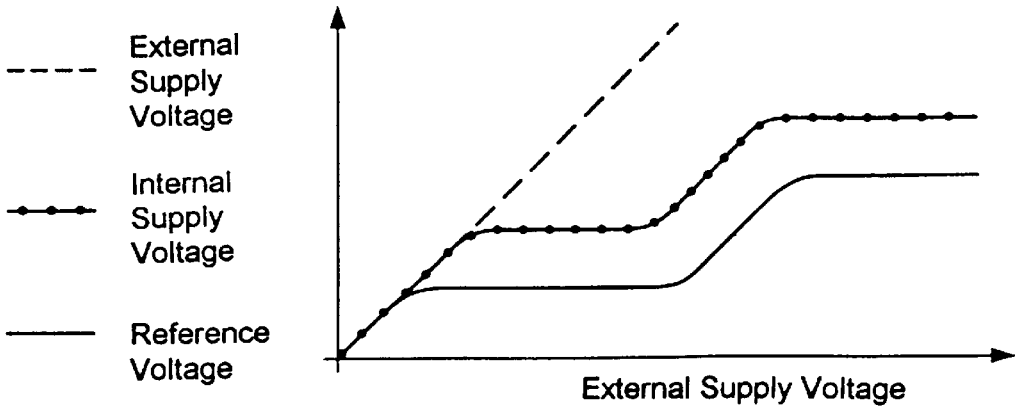
FIG. 3 is a graph showing the course of an internal supply voltage and a reference voltage in the circuit configuration of the invention.

FIG. 3 shows the dependency of the internal supply voltage $V_{CCint}$ and the reference voltage $V_{Reference}$ on the external supply voltage $V_{CCext}$ in the circuit configuration of the invention. The internal supply voltage $V_{CCint}$ assumes two defined, different values, depending on the magnitude of the external supply voltage $V_{CCext}$.

We claim:

1. A circuit configuration, comprising:

a memory cell array having a voltage supply input;

a reference voltage generator including:

a first constant voltage source having an output supplying a first constant reference voltage;

a second constant voltage source having an output supplying a second constant reference voltage; and a switching circuit having a first input connected to said output of said first constant voltage source, a second input connected to said output of said second constant voltage source, and an output;

said switching circuit having a first switching state for providing said first constant reference voltage to said output of said switching circuit and a second switching state for providing said second constant reference voltage to said output of said switching circuit;

said output of said switching circuit for supplying an internal voltage to said voltage supply input of said memory cell array, said internal voltage being proportional to a voltage selected from the group consisting of said first constant reference voltage and said second constant reference voltage.

2. The circuit configuration according to claim 1, including a device connected to said output of said switching circuit for generating said internal voltage.

3. The circuit configuration according to claim 1, wherein said reference voltage generator has a switching transistor connected through a circuit node in series with a diode chain.

4. The circuit configuration according to claim 3, wherein said diode chain has ends, and said switching transistor has a channel side connected to an external supply voltage and to one of the ends of said diode chain.

5. The circuit configuration according to claim 3, wherein said reference voltage generator includes a circuit device enabling said internal voltage to be proportional to said voltage selected from the group consisting of said first constant voltage and said second constant voltage as a function of a potential at said circuit node.

6. The circuit configuration according to claim 1, wherein at least one of said first constant voltage source and said second constant voltage source includes a double mirror circuit.

* * * * *